United States Patent [19]

Donahue et al.

[11] Patent Number: 4,498,613

[45] Date of Patent: Feb. 12, 1985

[54] SUPPORT DEVICE FOR NURSING BOTTLES AND AMUSEMENT ITEMS

[76] Inventors: Barbara S. Donahue, 27 Madison St., Glen Ridge, N.J. 07028; Irene Ficca, 12 Gilbert Pl., Clifton, N.J. 07011

[21] Appl. No.: 540,310

[22] Filed: Oct. 11, 1983

[51] Int. Cl.[3] ..... A45F 3/14; A47D 15/00; A61J 9/06

[52] U.S. Cl. ..... 224/251; 224/258; 224/901; 248/102; 446/28

[58] Field of Search ..... 248/102, 312, 315; 46/32; 211/74; 224/901, 257, 258, 251; 446/28

[56] References Cited

U.S. PATENT DOCUMENTS

| | | | |
|---|---|---|---|
| 1,683,176 | 9/1928 | Faulhaber | 215/100.5 |
| 2,303,728 | 12/1942 | Drayton et al. | 248/102 |
| 2,511,864 | 6/1950 | Meredith | 248/102 |
| 2,684,793 | 7/1954 | Warrick | 215/100.5 X |
| 2,882,645 | 4/1959 | Stivers | 46/32 X |
| 3,027,037 | 3/1962 | Bronson et al. | 215/100.5 |
| 3,087,277 | 4/1963 | McCook | 46/32 X |
| 3,184,883 | 5/1965 | McCook | 46/32 |
| 4,022,363 | 5/1977 | Eliassen | 211/74 X |
| 4,096,977 | 6/1978 | Barville et al. | 224/901 X |
| 4,220,302 | 9/1980 | Hampton et al. | 224/901 X |

FOREIGN PATENT DOCUMENTS

| | | | |
|---|---|---|---|
| 476390 | 8/1951 | Canada | 248/102 |

*Primary Examiner*—Allan N. Shoap

*Attorney, Agent, or Firm*—Howard E. Thompson, Jr.

[57] ABSTRACT

A support device is provided for nursing bottles and young child amusement items comprising a body encircling, resilient and adjustable strap having secured to a center, front portion thereof one end of a pliable, but non-extendible, band member approximately 9-inches long, the other end of said band member being fixedly secured to one side of a frustoconically contoured elastic loop member adapted to interlockingly engage the neck portion of nursing bottles and undercut portions of amusement devices.

The body encircling strap has free ends joined at the back of the wearer by a "Velcro" fastener or other adjustable fastener means permitting easy under-the-arm or over-the-shoulder attachment to, or detachment from, a young child; and the elasticity of the frustoconical elastic loop member permits easy adult attachment to, and detachment from, nursing bottles and appropriate child amusement items.

4 Claims, 4 Drawing Figures

SUPPORT DEVICE FOR NURSING BOTTLES AND AMUSEMENT ITEMS

This invention relates to a support device for nursing bottles and young child amusement items comprising a body encircling, resilient and adjustable strap having secured to a center, front portion thereof one end of a pliable, but nonextendible, band member approximately 9-inches long, the other end of said band member being fixedly secured to one side of a frustoconically contoured elastic loop member adapted to interlockingly engage the neck portion of nursing bottles and undercut portions of amusement devices.

The body encircling strap has free ends joined at the back of the wearer by a "Velcro" fastener or other adjustable fastener means permitting easy under-the-arm or over-the-shoulder attachment to, or detachment from, a young child; and the elasticity of the frustoconical elastic loop member permits easy adult attachment to, and detachment from, nursing bottles and appropriate child amusement items.

Mothers and others attending small children are confronted with a time consuming, and frequently awkward, problem in keeping nursing bottles and amusement items accessible to the small child when the attention of the mother or other attending individual is necessarily diverted by other activities. The problem is accentuated during any type of travel or moving about, as in a carriage or stroller and becomes particularly difficult when the small child must be taken along during supermarket shopping. While a small child might be quite attentive to a nursing bottle or an amusement item when initially given the bottle or item, the duration of attentiveness is frequently short; and when dropped the item frequently cannot be retrieved. Indeed, in many situations dropping of the item can result in its being lost, damaged or soiled thereby adding to the problems of the mother or attending individual.

An object of the present invention is to provide a body encircling device tethered to a frustoconically contoured elastic loop which can detachably engage the neck of nursing bottles and undercut portions of appropriate amusement items to assure that the bottle or item, when dropped by any small child, remains in a position to be retrieved if, and when, desired.

A further object of the invention is to provide a device of the character described which is of simple and inexpensive construction, which is easy for the mother or attending individual to use, and which at the same time prevents tampering by the small child user.

The device is intended for use with infants and small children during the period from initial ability of an infant to hold a nursing bottle to the end of the period in which nursing bottles are used. This will generally encompass an age range of about 6-months to 2–2½ years.

Practical use of the device on the child of one of the applicants has proven its utility many times over and has frequently caught the attention and interest of other mothers of small children in supermarkets, restaurants and other areas of co-mingling.

A preliminary Patent Office search failed to bring to light any prior patents directly relating to the novel structure herein disclosed. The closest prior patent found in the search was U.S. Pat. No. 4,096,977, issued June 27, 1978 to George W. Barville and Joel R. Peterson, Sr. While the device covered in the patent is intended for a generally similar purpose, it is, by comparison, exceedingly complicated and differs totally from the device of the present invention in the tethering and article engaging means.

Novel features of the present invention will be readily understood from a consideration of the following description, having reference to the accompanying drawing, in which a preferred adaptation of the invention has been illustrated with the various parts thereof identified by suitable reference characters in the several views, and in which.

Figure 1:
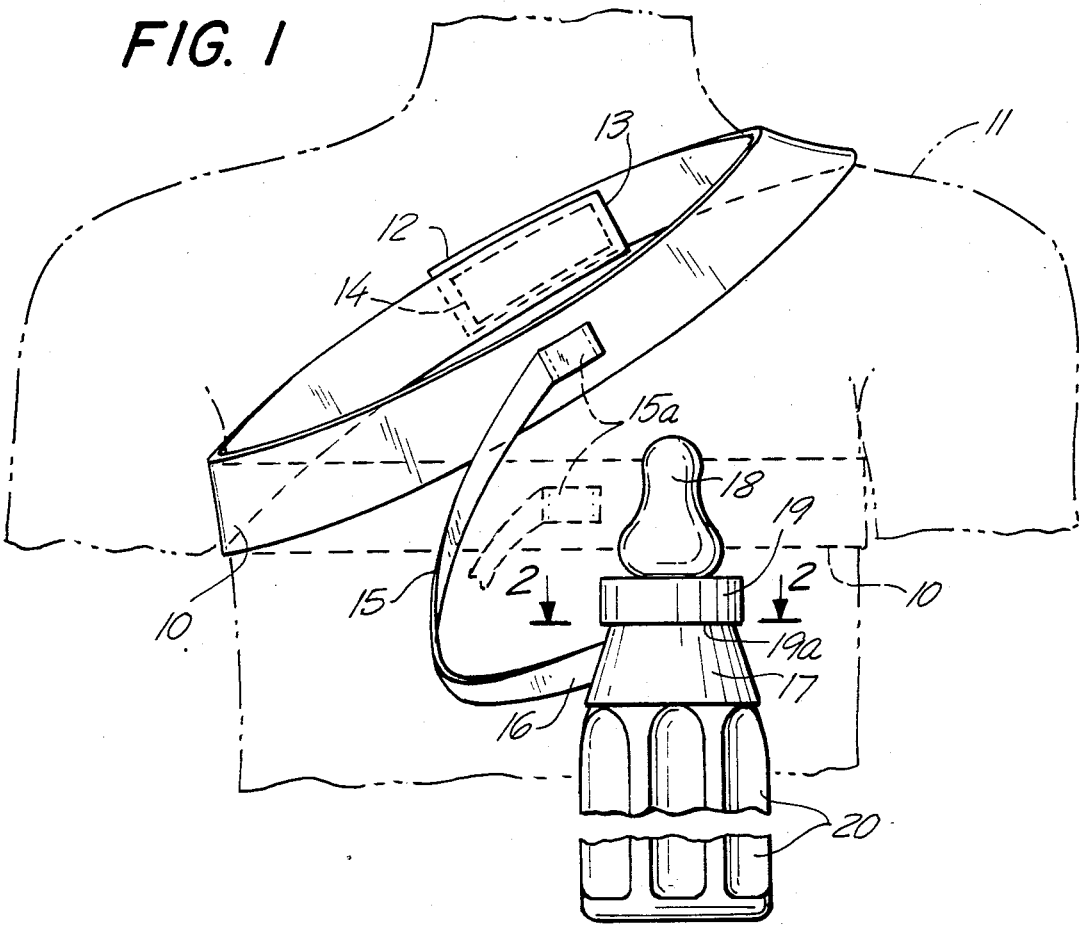
FIG. 1 is a front view of the device as arranged on the phantom body of the wearer and engaged with a nursing bottle.
Figure 2:
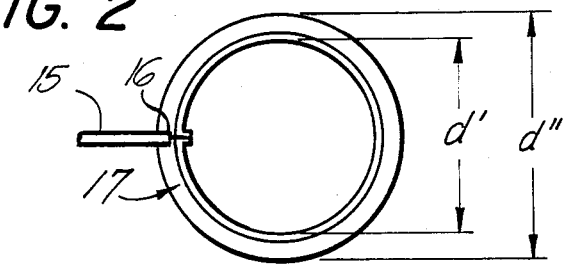
FIG. 2 is a fragmentary view of a portion of the device taken in the direction of the arrows 2—2 on FIG. 1.

As shown in the drawing the support device of the present invention comprises a strap 10 of longitudinally extendible material of a length to encircle the body 11 of a small child, and to provide at the rear of the body overlapping ends 12,13 adjustably secured together as by a "Velcro" fastener 14. It will be understood, however, that the ends 12,13 can be joined together by hooks, buttons, belt buckle, or any other adjustable fastening means.

While preferably intended for use in the under-the-arm and over-the-shoulder orientation shown in full lines in FIG. 1, the "Velcro" fastener 14 or other adjustable fastening means should be of a size and/or arrangement as to permit alternate mounting of the device with the strap 10 encircling the body 11 under both arms in accordance with the dotted line showing in FIG. 1.

One end 15*a* of a flexible, but non-extendible, band or ribbon 15 is secured to the strap 10 at a point which will be at the front, center of the body 11 in either mounting of the device. The other end 16 of the band or ribbon 15 is secured to a frustoconical loop 17 having circumferential extendibility; and the length of the band or ribbon 15 between the end mountings 15*a* and 16 is approximately 9-inches.

The frustoconical loop 17 has a top to bottom dimension as shown in FIG. 1 of about 1-inch and in the detached state has a top diameter d′ of about 1⅜-inches and a bottom diameter d″ of about 1⅞-inches. These dimensions coupled with a 70 to 90% circumferential extendibility in the frustoconical loop 17 permits the loop 17 to be enlarged for passage over the nipple 18 and retainer 19 of a nursing bottle 20. As nursing bottles generally have a diameter adjacent the retainer 19 of approximately 1½-inches and a diameter 1-inch below the retainer 19 of approximately 2–2¼-inches, it will be apparent that the loop 17 will closely encircle the bottle neck and have interlocking engagement against the lower edge 19*a* of the retainer 19. This close engagement with the bottle neck is sufficiently tight to prevent removal of the loop 17 from the bottle neck by young children of ages for which the device is intended, while permitting easy removal of the device by an adult through appropriate expansion of the loop 17.

While the strap 10, the band or ribbon 15 and the frustoconical loop 17 can be made from various materials, a preferred adaptation of the invention employs, in both the strap 10 and frustoconical loop 17, elastic fabric strapping which is approximately 1-inch wide and has an elastic elongation of about 70 to 90%. The strap 10 should be about 26 to 28-inches long allowing an adjustable overlap of the ends 12,13 of about 3 to 5-inches.

The band or ribbon 15 is suitably fashioned from grosgrain ribbon approximately $\frac{3}{8}$ inches wide, as providing the desired non-extendible flexibility and durable strength.

Figure 3:
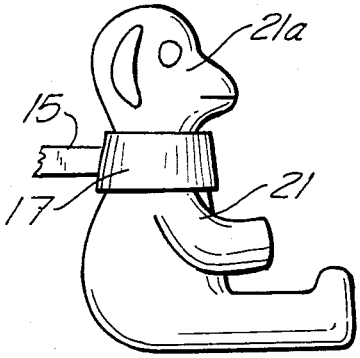
FIG. 3 is a fragmentary view of a portion of the device as engaged with an animated toy.
Figure 4:
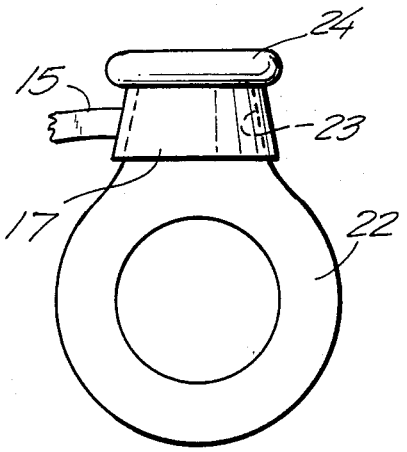
FIG. 4 is a fragmentary view of a portion of the device as engaged with a form of pacifier.

While the device is primarily intended for the support of a nursing bottle within easy reach of the small child, it will be understood that the device is equally effective as a means for supporting within reach of the small child various types of amusement items. By way of illustration the loop 17 has been shown in FIG. 3 in interlocking engagement with the neck portion of an animated toy 21. Many animated toys are available in which the neck portion is of a size to receive the loop 17, and the head 21*a* is sufficiently small to permit the loop 17 to be passed over the head portion 21*a* when the loop 17 is elastically extended.

For very young children the device can be used to support a pacifier or teething ring 22 having an extension 23 and terminal enlargement 24 for interlocking engagement with the loop 17. While pacifiers 22 having the particular structure above-described may not be currently available, they can easily be produced from molded rubber or plastics in appropriate sizes for use by infants and other small children having teething problems.

Because the support device employs a simple, single strap intended for body encirclement, it is also well adapted to the tethered support of nursing bottles or amusement items on objects within the child's environment. By way of example, the strap 10 can be wrapped around rails of a crib or playpen, or around parts of a stroller or car-seat in such a way as to support the bottle or amusement item in close proximity to the child, and permit retrieval when dropped by the child.

A distinct advantage of the support device of the present invention is that its extreme simplicity and flexibility permits it to be easily carried in a pocket or purse when not in use, while permitting quick and easy attachment of the device to a small child, or to an environmental object, when tethered support of a nursing bottle or amusement item is desired.

Various changes and modifications in the support device herein disclosed may occur to those skilled in the art; and to the extent that such changes and modifications are embraced by the appended claims, it is to be understood that they constitute part of the present invention.

We claim:

1. A support device for nursing bottles and young child amusement items, said device comprising a body encircling, resilient and adjustable strap of a length to selectively permit mounting of the device on a young child in either an angular, over-the-shoulder, or transverse, under-the-arm, orientation, said strap having secured to a center, front portion thereof one end of a pliable, but non-extendible, band member about 9-inches long, the other end of said band member being fixedly secured to the exterior side of a frustoconically contoured and circumferentially elastic loop member between the ends of said loop member, said loop member having a top diameter of about $1\frac{3}{8}$-inches and a bottom diameter of about $1\frac{7}{8}$-inches adapted to interlockingly engage the neck portions of nursing bottles, below the nipple retainers thereof, and undercut portions of amusement devices.

2. A support device as defined in claim 1, wherein the elasticity of the frustoconical loop has a circumferential extendibility of about 70 to 90% permitting enlargement of said loop to be freely passed over said nipple retainers.

3. A support device as defined in claim 1, wherein both said body encircling strap and frustoconical loop are fashioned from elastic fabric strapping about 1-inch wide and having a longitudinal extendibility of about 70 to 90%.

4. A support device as defined in claim 1, wherein said band member is fashioned from grosgrain ribbon approximately $\frac{3}{8}$ inches in width, as providing the desired combination of non-extendible flexibility and durable strength.

* * * * *